US011699378B2

(12) United States Patent
Baek et al.

(10) Patent No.: US 11,699,378 B2
(45) Date of Patent: Jul. 11, 2023

(54) GAMMA REFERENCE VOLTAGE GENERATOR SELECTING ONE OF BLACK CANDIDATE VOLTAGES AS BLACK GAMMA VOLTAGE AND DISPLAY APPARATUS INCLUDING THE SAME

(71) Applicant: SAMSUNG DISPLAY CO., LTD., Yongin-si (KR)

(72) Inventors: Yunki Baek, Suwon-si (KR); Nam-Gon Choi, Yongin-si (KR); Hansin Lim, Hwaseong-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 17/355,446

(22) Filed: Jun. 23, 2021

(65) Prior Publication Data

US 2022/0044616 A1 Feb. 10, 2022

(30) Foreign Application Priority Data

Aug. 10, 2020 (KR) ..... 10-2020-0100141

(51) Int. Cl.
*G09G 3/20* (2006.01)

(52) U.S. Cl.
CPC ... *G09G 3/2007* (2013.01); *G09G 2300/0842* (2013.01); *G09G 2310/027* (2013.01);
(Continued)

(58) Field of Classification Search
CPC ..... G09G 3/20; G09G 3/2007; G09G 3/2011; G09G 3/2092; G09G 3/2096; G09G 3/3685; G09G 3/3692; G09G 3/3696; G09G 5/003; G09G 5/005; G09G 5/006; G09G 2300/0842; G09G 2310/0243;
(Continued)

(56) References Cited

U.S. PATENT DOCUMENTS 5,132,796 A * 7/1992 Topper ..... H04N 5/20 348/254
2005/0057482 A1* 3/2005 Youngblood ..... G09G 3/3688 345/100

(Continued)

FOREIGN PATENT DOCUMENTS

KR 10-2016-0111555 9/2016
KR 10-2019-0043661 4/2019
KR 10-2019-0047298 5/2019

(Continued)

*Primary Examiner* — Keith L Crawley
(74) *Attorney, Agent, or Firm* — F. Chau & Associates, LLC

(57) ABSTRACT

A gamma reference voltage generator includes a first resistor string, black voltage setters, a selector, and a second resistor string. The first resistor string receives a first reference voltage and a second reference voltage. The black voltage setters extract a plurality of black candidate voltages from the first resistor string. The selector selects one of the black candidate voltages as a black gamma voltage based on a selection signal. The second resistor string receives a first voltage corresponding to one of the black candidate voltages and a second voltage extracted from the first resistor string. In addition, the gamma reference voltage generator includes gamma voltage setters that extract a plurality of gamma voltages from the second resistor string.

22 Claims, 9 Drawing Sheets

(52) U.S. Cl.
CPC ..... *G09G 2310/0243* (2013.01); *G09G 2310/0291* (2013.01); *G09G 2320/0276* (2013.01)

(58) Field of Classification Search
CPC ..... G09G 2310/0264; G09G 2310/027; G09G 2310/0289; G09G 2310/0291; G09G 2320/0233; G09G 2320/0238; G09G 2320/0242; G09G 2320/0271; G09G 2320/0276; G09G 2320/0613; G09G 2320/0673; G09G 2360/16
See application file for complete search history.

(56) References Cited

U.S. PATENT DOCUMENTS

| | | | | |
|---|---|---|---|---|
| 2013/0271507 | A1* | 10/2013 | Kim | G09G 3/3225 345/690 |
| 2014/0184657 | A1* | 7/2014 | Lee | G09G 5/10 345/690 |
| 2016/0275842 | A1* | 9/2016 | Seok | G09G 3/3233 |
| 2017/0076656 | A1* | 3/2017 | Bang | G09G 3/2092 |
| 2017/0084242 | A1* | 3/2017 | Kang | G09G 3/3685 |
| 2019/0156737 | A1* | 5/2019 | Choi | G09G 3/3225 |
| 2019/0355291 | A1* | 11/2019 | Kim | G09G 3/2003 |

FOREIGN PATENT DOCUMENTS

| | | |
|---|---|---|
| KR | 10-2019-0049977 | 5/2019 |
| KR | 10-2019-0128017 | 11/2019 |

* cited by examiner

GAMMA REFERENCE VOLTAGE GENERATOR SELECTING ONE OF BLACK CANDIDATE VOLTAGES AS BLACK GAMMA VOLTAGE AND DISPLAY APPARATUS INCLUDING THE SAME

CROSS-REFERENCE TO RELATED APPLICATIONS

This application claims priority under 35 U.S.C. § 119 to Korean Patent Application No. 10-2020-0100141, filed on Aug. 10, 2020, in the Korean Intellectual Property Office KIPO, the contents of which are herein incorporated by reference in its entirety.

BACKGROUND

1. Field

One or more embodiments described herein relate to a gamma reference voltage generator and a display apparatus including a gamma reference voltage generator.

2. Description of the Related Art

Some displays use a gamma reference voltage generator to perform grayscale correction of moving image data. For example, when the grayscale value of a pixel changes from a black grayscale value to a white grayscale value, the luminance corresponding to the white grayscale value may not reach a desired luminance because of image overlap or color sticking. Also, when a single color low grayscale image is output, current leakage between channels of color pixels may occur. This may cause a distortion in the single color low grayscale image, or may cause the image to not be displayed at all.

SUMMARY

One or more embodiments described herein provide a gamma reference voltage generator that selectively generates a black grayscale voltage, which, in turn, may enhance the display quality of a display panel. These or other embodiments provide a display apparatus including a gamma reference voltage generator, which, for example, may correspond to the aforementioned gamma reference voltage generator.

In accordance with one or more embodiments, a gamma reference voltage generator includes a first resistor string configured to receive a first reference voltage and a second reference voltage, a plurality of black voltage setters configured to extract a plurality of black candidate voltages from the first resistor string, a selector configured to select one of the black candidate voltages as a black gamma voltage based on a selection signal, the selection signal generated based on a black level command signal applied from a host; a second resistor string configured to receive a first voltage and a second voltage, the first voltage corresponding to one of the black candidate voltages and the second voltage extracted from the first resistor string; and a plurality of gamma voltage setters configured to extract a plurality of gamma voltages from the second resistor string.

In accordance with one or more embodiments, a display apparatus includes a display panel configured to display an image, a driving controller configured to receive input image data and to convert the input image data into a data signal, a gamma reference voltage generator configured to generate a gamma voltage corresponding to the data signal, and a data driver configured to output the gamma voltage to the display panel based on the data signal. The gamma reference voltage generator selects one of a plurality of black candidate voltages as a black gamma voltage to be output to the display panel based on a selection signal. The selection signal is based on a black level command signal from a host.

BRIEF DESCRIPTION OF THE DRAWINGS

The above and other features of the present inventive concept will become more apparent by describing in detailed embodiments thereof with reference to the accompanying drawings, in which.

DETAILED DESCRIPTION OF THE INVENTIVE CONCEPT

Hereinafter, the present inventive concept will be explained in detail with reference to the accompanying drawings.

Figure 1:
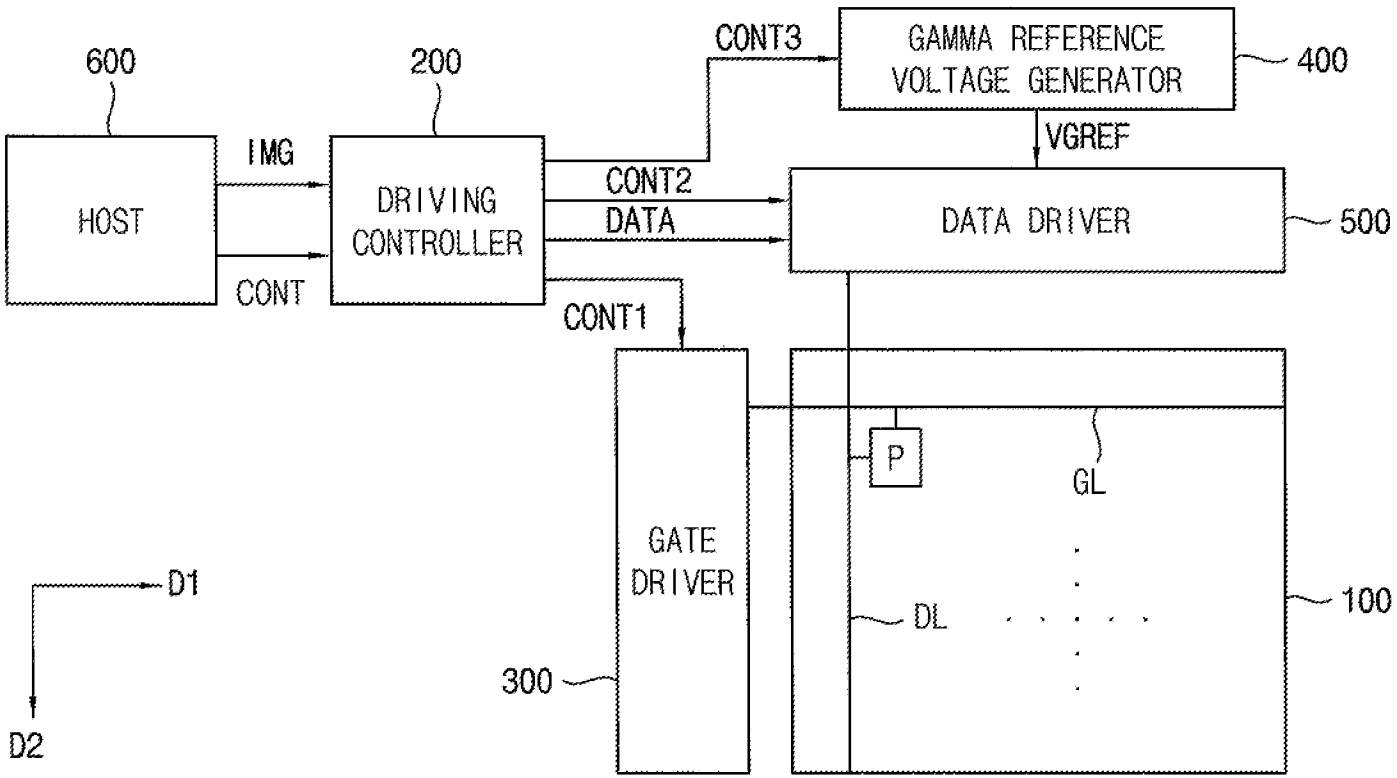
FIG. 1 illustrates an embodiment of a display apparatus.

FIG. 1 is a block diagram illustrating an embodiment of a display apparatus which includes a display panel 100 and a display panel driver. The display panel driver may include, for example, a driving controller 200, a gate driver 300, a gamma reference voltage generator 400, and a data driver 500. In one embodiment, the display apparatus may further include a host 600 or host 600 may be an external element that is coupled to the display apparatus.

The display panel 100 has a display region to display images and a peripheral region adjacent to the display region. The display panel 100 includes a plurality of gate lines GL, a plurality of data lines DL and a plurality of pixels P connected to the gate lines GL and the data lines DL. The gate lines GL extend in a first direction D1 and the data lines DL extend in a second direction D2 crossing the first direction D1.

The driving controller 200 receives image data IMG and a control signal CONT from the host 600. The input image data IMG may include color image data, e.g., red image data, green image data and blue image data. In one embodiment, the input image data IMG may include also white image data. In one embodiment, the input image data IMG may include magenta image data, yellow image data and cyan image data, or image data including another combination of colors. The input control signal CONT may include a master clock signal and a data enable signal, and in some embodiments may include a vertical synchronizing signal and a horizontal synchronizing signal. In the present embodiment, the input control signal CONT, which the host 600 outputs to the driving controller 200, may include a black level command signal BLC for setting a level of a black gamma voltage.

The driving controller 200 generates a first control signal CONT1, a second control signal CONT2, a third control signal CONT3 and a data signal DATA based on the input image data IMG and the input control signal CONT. The driving controller 200 may generate the first control signal CONT1 for controlling operation of the gate driver 300 based on the input control signal CONT, and may output the first control signal CONT1 to the gate driver 300. The first control signal CONT1 may further include a vertical start signal and a gate clock signal.

The driving controller 200 may generate the second control signal CONT2 for controlling operation of the data driver 500 based on the input control signal CONT, and may output the second control signal CONT2 to the data driver 500. The second control signal CONT2 may include a horizontal start signal and a load signal.

The driving controller 200 may generate the data signal DATA based on the input image data IMG and may output the data signal DATA to the data driver 500.

The driving controller 200 may generate the third control signal CONT3 for controlling an operation of the gamma reference voltage generator 400 based on the input control signal CONT. The driving controller 200 may output the third control signal CONT3 to the gamma reference voltage generator 400.

The gate driver 300 may generate gate signals to drive the gate lines GL in response to the first control signal CONT1 from the driving controller 200. The gate driver 300 may output the gate signals to the gate lines GL. For example, the gate driver 300 may sequentially output the gate signals to the gate lines GL. In one embodiment, the gate driver 300 may be mounted in or be coupled to the peripheral region of the display panel 100. For example, gate driver 300 may be integrated on the peripheral region of the display panel 100.

The gamma reference voltage generator 400 may generate a gamma reference voltage VGREF in response to the third control signal CONT3 from the driving controller 200. The gamma reference voltage generator 400 may provide the gamma reference voltage VGREF to the data driver 500. The gamma reference voltage VGREF may have a value corresponding to a level of the data signal DATA. In an embodiment, the gamma reference voltage generator 400 may be disposed in or coupled to the driving controller 200, or may be disposed in or coupled to the data driver 500.

The data driver 500 may receive the second control signal CONT2 and the data signal DATA from the driving controller 200 and the gamma reference voltage VGREF from the gamma reference voltage generator 400. The data driver 500 convert the data signal DATA to analog data voltages using the gamma reference voltage VGREF. The data driver 500 may output the data voltages to the data lines DL.

Figure 2:
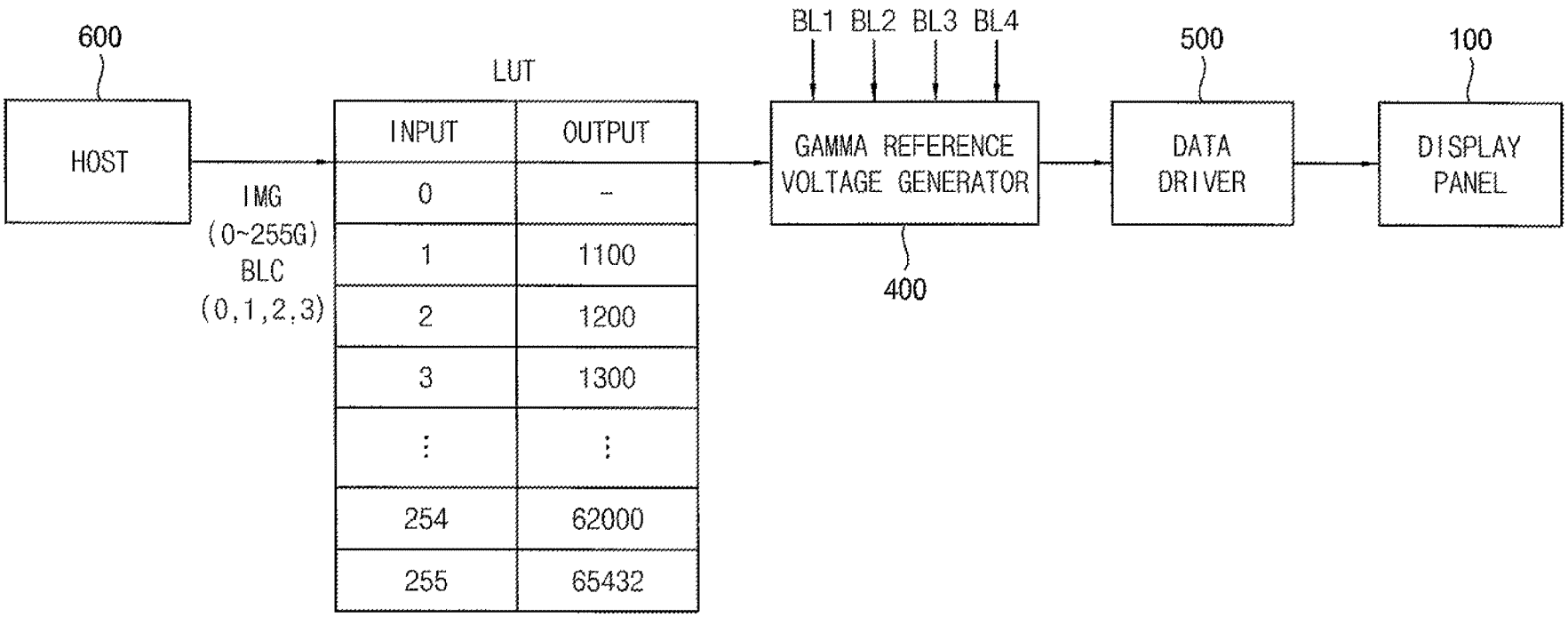
FIG. 2 illustrates an embodiment of displaying an image on a display panel.

FIG. 2 is a block diagram illustrating an embodiment of displaying an image on the display panel 100 of FIG. 1. Referring to FIGS. 1 and 2, the display panel 100 displays the image under control of the driving controller 200. For example, the driving controller 200 may receive the input image data IMG and convert the input image data IMG to a data signal DATA. The gamma reference voltage generator 400 may generate a gamma voltage corresponding to the data signal DATA, and the data driver 500 may output the gamma voltage to the display panel 100 based on the data signal DATA.

A black gamma voltage output to the display panel 100 may be selected from among a plurality of black candidate voltages based on a selection signal, e.g., a black level command signal BLC. In one embodiment, the host 600 may output the input image data IMG and a black level command signal BLC to the driving controller 200. The input image data IMG may include a grayscale value in a predetermined range, e.g., between 0 and 255. The grayscale value may be in a different range in another embodiment.

When the number of black candidate voltages is four, the black level command signal BLC may have four values of 0, 1, 2 and 3. In accordance with one embodiment, these values may be selected as follows. When the black level command signal BLC has a value of 0, a first black candidate voltage may be selected to be the black gamma voltage. When the black level command signal BLC has a value of 1, a second black candidate voltage may be selected to be the black gamma voltage. When the black level command signal BLC has a value of 2, a third black candidate voltage may be selected to be the black gamma voltage. When the black level command signal BLC has a value of 3, a fourth black candidate voltage may be selected to be the black gamma voltage.

The driving controller 200 may include a lookup table LUT storing output data OUTPUT corresponding to an input grayscale value INPUT of the input image data IMG In the present embodiment, the lookup table LUT may not store an output value for a grayscale value of 0, but may store output values for all, other, or predetermined grayscale values except for 0. The grayscale value of 0 of the input image data IMG may correspond to a black grayscale value. In this case, four black candidate voltage setting values BL1, BL2, BL3 and BL4 may be input to the gamma reference voltage generator 400. Embodiments corresponding to the structure and operation of the gamma reference voltage generator 400 are explained with reference to FIGS. 3 and 4.

Figure 3:
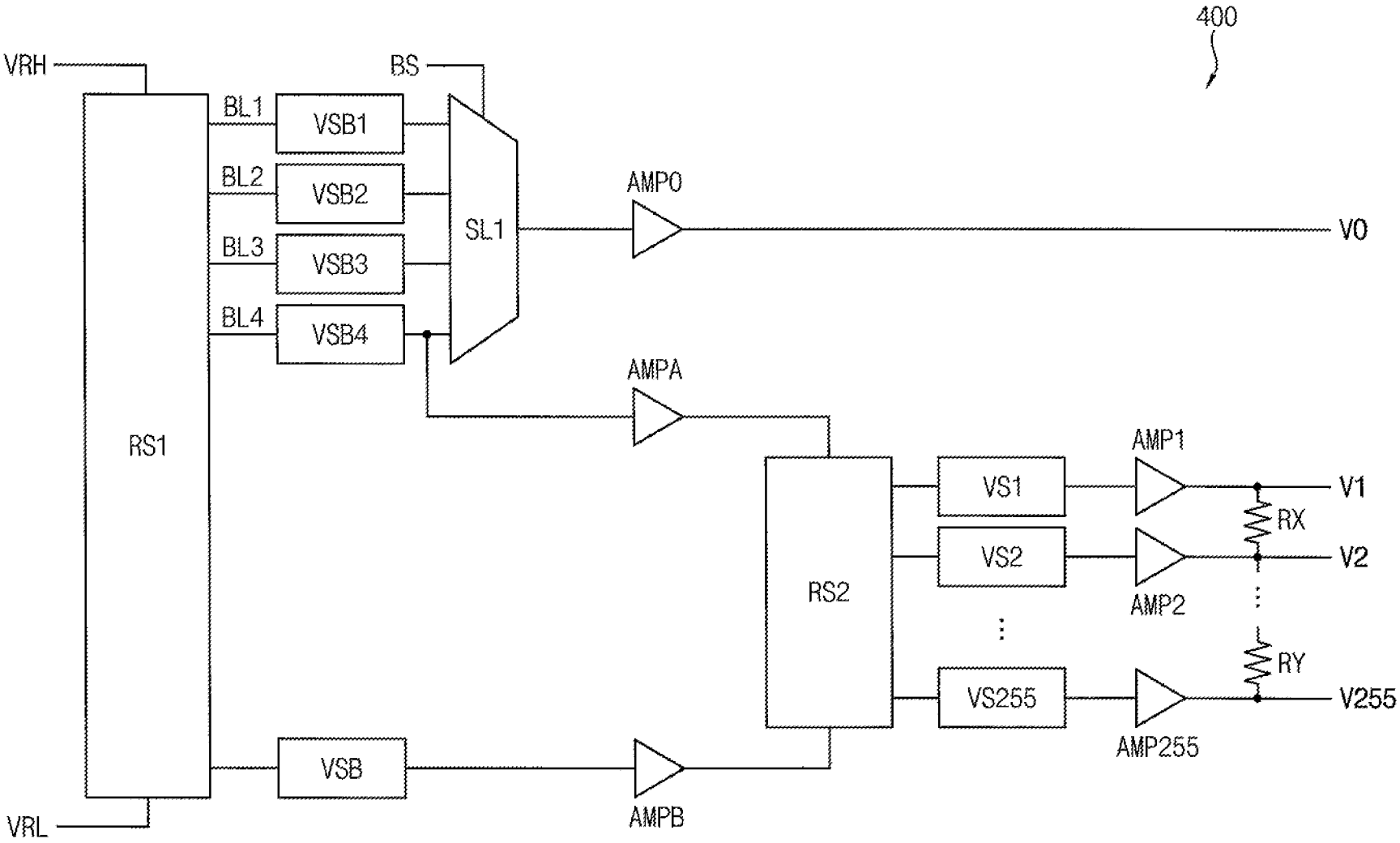
FIG. 3 illustrates an embodiment of a gamma reference voltage generator.
Figure 4:
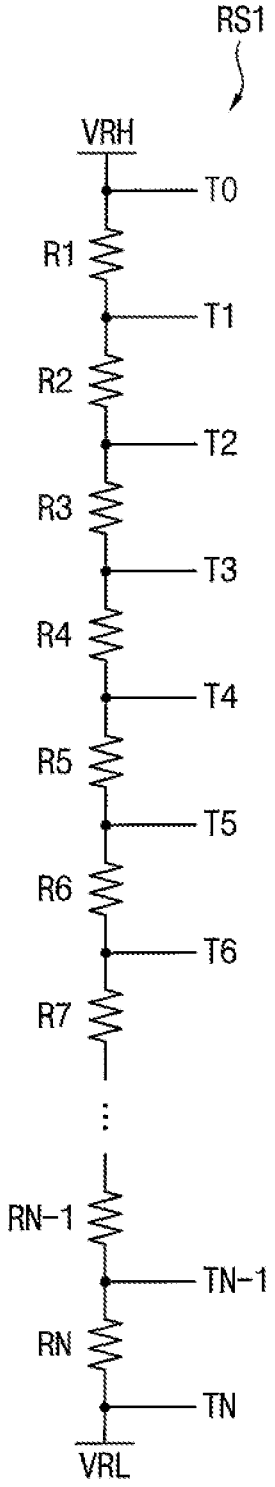
FIG. 4 illustrates an embodiment of a first resistor string.

FIG. 3 is a circuit diagram illustrating an embodiment of the gamma reference voltage generator 400 of FIG. 1. FIG. 4 is a circuit diagram illustrating an embodiment of a first resistor string RS1 of FIG. 3.

Referring to FIGS. 1 to 4, the gamma reference voltage generator 400 includes a first resistor string RS1, a plurality of black voltage setters VSB1, VSB2, VSB3 and VSB4, a selector SL1, a second resistor string RS2 and a plurality of gamma voltage setters VS1, VS2, . . . , VS255. A high reference voltage VRH and a low reference voltage VRL may be coupled to the first resistor string RS1. The first resistor string RS1 may include a plurality of resistors R1 to RN connected to in series, and output terminals T0 to TN may be disposed at respective nodes of the first resistor string RS1.

A first output terminal T0 may be at an input terminal of the high reference voltage VRH. A second output terminal T1 is coupled between a first resistor R1 and a second resistor R2. A third output terminal T2 is coupled between the second resistor R2 and a third resistor R3. A fourth output terminal T3 is coupled between the third resistor R3 and a fourth resistor R4. An N-th output terminal TN−1 may be between an N−1-th resistor RN−1 and an N-th resistor RN. An N+1-th output terminal TN may be at an input terminal of the low reference voltage VRL.

The black voltage setters VSB1, VSB2, VSB3 and VSB4 may extract respective ones of the black candidate voltages from the first resistor string RS1. For example, a first black candidate voltage setting value BL1 may be applied to a first black voltage setter VSB1. A specific voltage between the high reference voltage VRH and the low reference voltage VRL may be extracted from the first resistor string RS1 as a first black candidate voltage according to the first black candidate voltage setting value BL1. The first black candidate voltage setting value BL1 may determine that the first black candidate voltage is to be extracted from a certain one of the first to N+1-th output terminals T0 to TN of first resistance string RS1.

A second black candidate voltage setting value BL2 may be applied to a second black voltage setter VSB2. A specific voltage between the high reference voltage VRH and the low reference voltage VRL may be extracted from the first resistor string RS1 as a second black candidate voltage according to the second black candidate voltage setting value BL2.

A third black candidate voltage setting value BL3 may be applied to a third black voltage setter VSB3. A specific voltage between the high reference voltage VRH and the low reference voltage VRL may be extracted from the first resistor string RS1 as a third black candidate voltage according to the third black candidate voltage setting value BL3.

A fourth black candidate voltage setting value BL4 may be applied to a fourth black voltage setter VSB4. A specific voltage between the high reference voltage VRH and the low reference voltage VRL may be extracted from the first resistor string RS1 as a fourth black candidate voltage according to the fourth black candidate voltage setting value BL4.

In one embodiment, the first black candidate voltage may be greater than the second black candidate voltage, the second black candidate voltage may be greater than the third black candidate voltage, and the third black candidate voltage may be greater than the fourth black candidate voltage.

The selector SL1 may select one of the black candidate voltages as the black gamma voltage based on the selection signal BS. The selection signal BS may be generated, for example, based on the black level command signal BLC.

In the present embodiment, the selector SL1 may include a decoder SL1 outputting one of the black candidate voltages in response to the selection signal BS. For example, when the selection signal BS represents the first black candidate voltage, the selector SL1 outputs the first black candidate voltage as the black gamma voltage. When the selection signal BS represents the second black candidate voltage, the selector SL1 outputs the second black candidate voltage as the black gamma voltage. When the selection signal BS represents the third black candidate voltage, the selector SL1 outputs the third black candidate voltage as the black gamma voltage. When the selection signal BS represents the fourth black candidate voltage, selector SL1 outputs the fourth black candidate voltage as the black gamma voltage.

The gamma reference voltage generator 400 may further include a black gamma voltage output amplifier AMP0 connected to the decoder SL1.

A first voltage and a second voltage may be applied to the second resistor string RS2. The first voltage may be one of the black candidate voltages, e.g. voltages corresponding to first to fourth black voltage setters VSB1 to VSB4. In one embodiment, the first voltage may be a minimum voltage (e.g., a voltage corresponding to the fourth black voltage setter VSB4) among the black candidate voltages. The second voltage may be extracted from the first resistor string RS1. The second voltage may be extracted from the first resistor string RS1 by a second voltage setter VSB.

The gamma reference voltage generator 400 may further include a first amplifier AMPA and a second amplifier AMPB. The first amplifier AMPA may output the first voltage to the second resistor string RS2. The second amplifier AMPB may output the second voltage to the second resistor string RS2. The first amplifier AMPA is connected to the fourth black voltage setter VSB4 in FIG. 3, but may be connected in a different manner in another embodiment. For example, the first amplifier AMPA may be connected any one of the first to fourth black voltage setters VSB1 to VSB4.

The gamma voltage setters VS1, VS2, . . . , VS255 may extract the gamma voltages V1, V2, . . . , V255. The gamma reference voltage generator 400 may include the gamma voltage setters VS1, VS2, . . . , VS255, which may be respectively connected to gamma voltage output amplifiers AMP1, AMP2, AMP255. In one embodiment, the gamma reference voltage generator 400 includes gamma voltage setters VS1, VS2, . . . , VS255 and the gamma voltage output amplifiers AMP1, AMP2, AMP255 which correspond to all of the grayscale values 0 to 255 of the input image data IMG In one embodiment, the gamma reference voltage generator 400 may include the gamma voltage setters and the gamma voltage output amplifiers which correspond to some (less than all) of the grayscale values of the input image data IMG In addition, the gamma reference voltage generator 400 may include gamma reference voltage generators for different color image data. For example, the gamma reference voltage generator 200 may include a red gamma reference voltage generator corresponding to red input image data, a green gamma reference voltage generator corresponding to green input image data, and a blue gamma reference voltage generator corresponding to blue input image data.

The gamma reference voltage generator 400 may further include a plurality of output resistors RX, . . . , RY connected between the gamma voltage output amplifiers AMP1, AMP2, . . . , AMP255.

The second resistor string RS2 may include resistors connected in series and output terminals disposed between the resistors like the first resistor string RS1. For example, a specific voltage between the first voltage and the second voltage may be extracted from the second resistor string RS2 as a first gamma voltage according to a first gamma voltage setting value applied to a first gamma voltage setter VS1. A specific voltage between the first voltage and the second voltage may be extracted from the second resistor string RS2 as a second gamma voltage according to a second gamma voltage setting value applied to a second gamma voltage setter VS2.

The first gamma setting value may be, for example, an output value of 1100 for a grayscale value of 1 in the lookup table LUT of FIG. 2. The second gamma setting value may be, for example, an output value of 1200 for a grayscale value of 2 in the lookup table LUT of FIG. 2.

Figure 5:
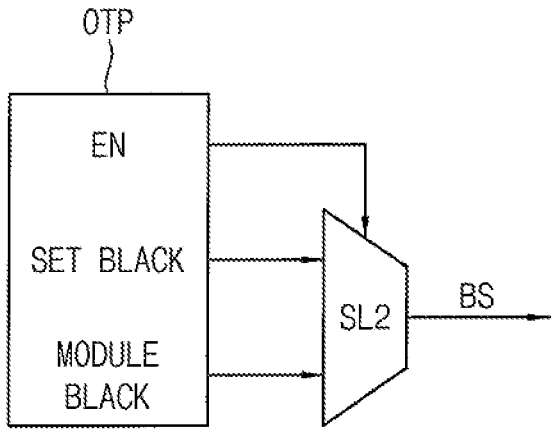
FIG. 5 illustrates an embodiment of a selection signal generator.

FIG. 5 is a block diagram illustrating an embodiment of a selection signal generator that generates a selection signal BS applied to the gamma reference voltage generator 400 of FIG. 3.

Referring to FIGS. 1 to 5, the selection signal generator may include a first nonvolatile memory OTP storing a black selection enable signal EN and a set black value SET BLACK from the host 600 and a module black value MODULE BLACK set by the driving controller 200. In the present embodiment, the first nonvolatile memory OTP may be an one time programmable memory.

The selection signal BS may be determined to be one of the set black value SET BLACK and the module black value MODULE BLACK, output in response to the black selection enable signal EN. For example, when the black selection enable signal EN has a first (e.g., inactive) value, the operation of selecting the black gamma value may be inactivated. When the black selection enable signal EN has the inactive value, the black gamma voltage may be determined to the module black value MODULE BLACK. The module black value MODULE BLACK may be set, for example, by a manufacturer in an inspection operation of the display panel 100 and may be stored in the driving controller 200.

If the second black candidate voltage (among the first to fourth black candidate voltages) is determined, for example, as an optimal black gamma voltage by the module black value (MODULE BLACK) in the inspection operation, the selection signal BS may output a value for selecting the second black candidate voltage (from among the first to fourth black candidate voltages) as the black gamma voltage (e.g. outputting 1 among 0, 1, 2 and 3) when the black selection enable signal EN has the inactive value.

When, for example, the black selection enable signal EN has a second (e.g., active) value, the operation of selecting the black gamma value may be activated and the set black value SET BLACK may be output as the selection signal BS. When the set black value SET BLACK represents the third black candidate voltage (from among the first to fourth black candidate voltages) as the black gamma voltage, the selection signal BS may output a value for selecting the third black candidate voltage (from among the first to fourth black candidate voltages) as the black gamma voltage, e.g., output 2 among 0, 1, 2 and 3. The set black value SET BLACK may be the black level command signal BLC.

According to the present embodiment, the black grayscale value of the display apparatus may be properly selected using the selector of the gamma reference voltage generator 400. In one embodiment, the black grayscale value of the display apparatus may be properly selected so that a first frame response (FFR) issue (e.g., in which luminance corresponding to the white grayscale value does not reach the desired luminance in a first frame that changes from the black grayscale value to the white grayscale value) may be reduced or prevented. In addition, a leakage current issue (e.g., in which the display panel does not represent a single color low grayscale image due to the current leakage between the channels of the color pixels (e.g., red pixels, green pixels, blue pixels) may be reduced or prevented. Therefore, the display quality of the display panel may be enhanced.

Figure 6:
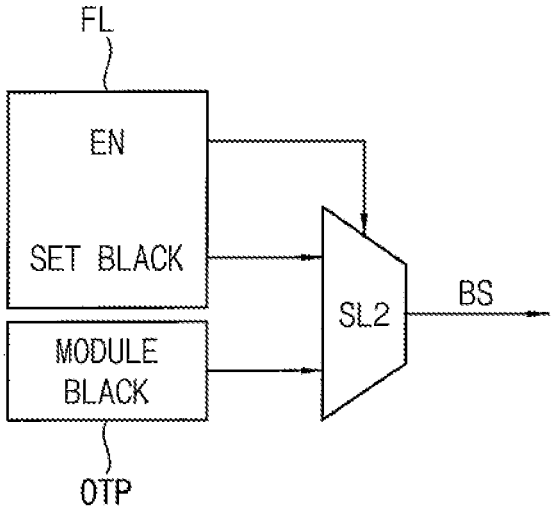
FIG. 6 illustrates an embodiment of a selection signal generator.

FIG. 6 is a block diagram illustrating an embodiment of a selection signal generator of a display apparatus. The gamma reference voltage generator and the display apparatus according to this embodiment is substantially the same as the gamma reference voltage generator and the display apparatus of the embodiment of FIGS. 1 to 5, except for the selection signal generator. Thus, the same reference numerals will be used to refer to the same or like parts as those described in the previous embodiment of FIGS. 1 to 5.

Referring to FIGS. 1 to 4 and 6, the display apparatus includes a display panel 100 and a display panel driver. The display panel driver includes a driving controller 200, a gate driver 300, a gamma reference voltage generator 400 and a data driver 500. The display apparatus may further include a host 600 or the host 600 may be an external element coupled to the display apparatus.

A black gamma voltage output to the display panel 100 may be selected among a plurality of black candidate voltages based on a selection signal. The selection signal may be output from a selection signal generator, which may include a first nonvolatile memory FL and a second nonvolatile memory OTP. The first nonvolatile memory FL may output a black selection enable signal EN and a black value SET BLACK. The second nonvolatile memory OTP may store a module black value MODULE BLACK set by the driving controller 200. In the present embodiment, the first nonvolatile memory FL may be a flash memory and the second nonvolatile memory OTP may be an one time programmable memory.

The selection signal BS may be determined to one of the set black value SET BLACK or the module black value MODULE BLACK in response to the black selection enable signal EN. For example, when the black selection enable signal EN has an inactive value, the operation of selecting the black gamma value may be inactivated. When the black selection enable signal EN has the inactive value, the black gamma voltage may be determined to the module black value MODULE BLACK. For example, when the black selection enable signal EN has an active value, the operation of selecting the black gamma value may be activated and the set black value SET BLACK may be outputted as the selection signal BS.

According to the present embodiment, the black grayscale value of the display apparatus may be properly selected using the selector of the gamma reference voltage generator 400. The black grayscale value of the display apparatus is properly selected so that a first frame response (FFR) issue (e.g., in which the luminance corresponding to the white grayscale value does not reach the desired luminance in the first frame that changes from the black grayscale value to the white grayscale value) may be reduced or prevented. In addition, a leakage current issue (e.g., in which the display panel does not represent the single color low grayscale image due to the current leakage between the channels of color pixels (e.g., red pixels, the green pixels and the blue pixels)) may be reduced or prevented. Therefore, display quality of the display panel may be enhanced.

Figure 7:
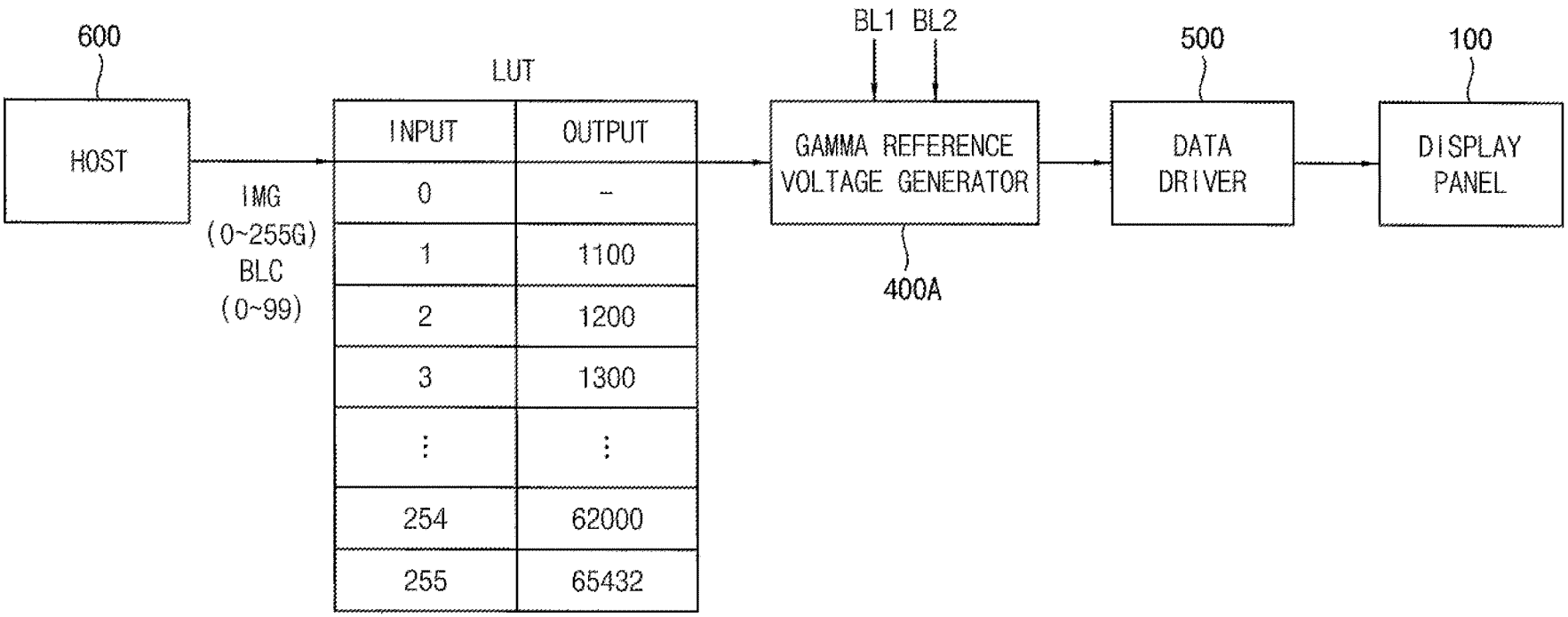
FIG. 7 illustrates an embodiment of displaying an image on a display panel.
Figure 8:
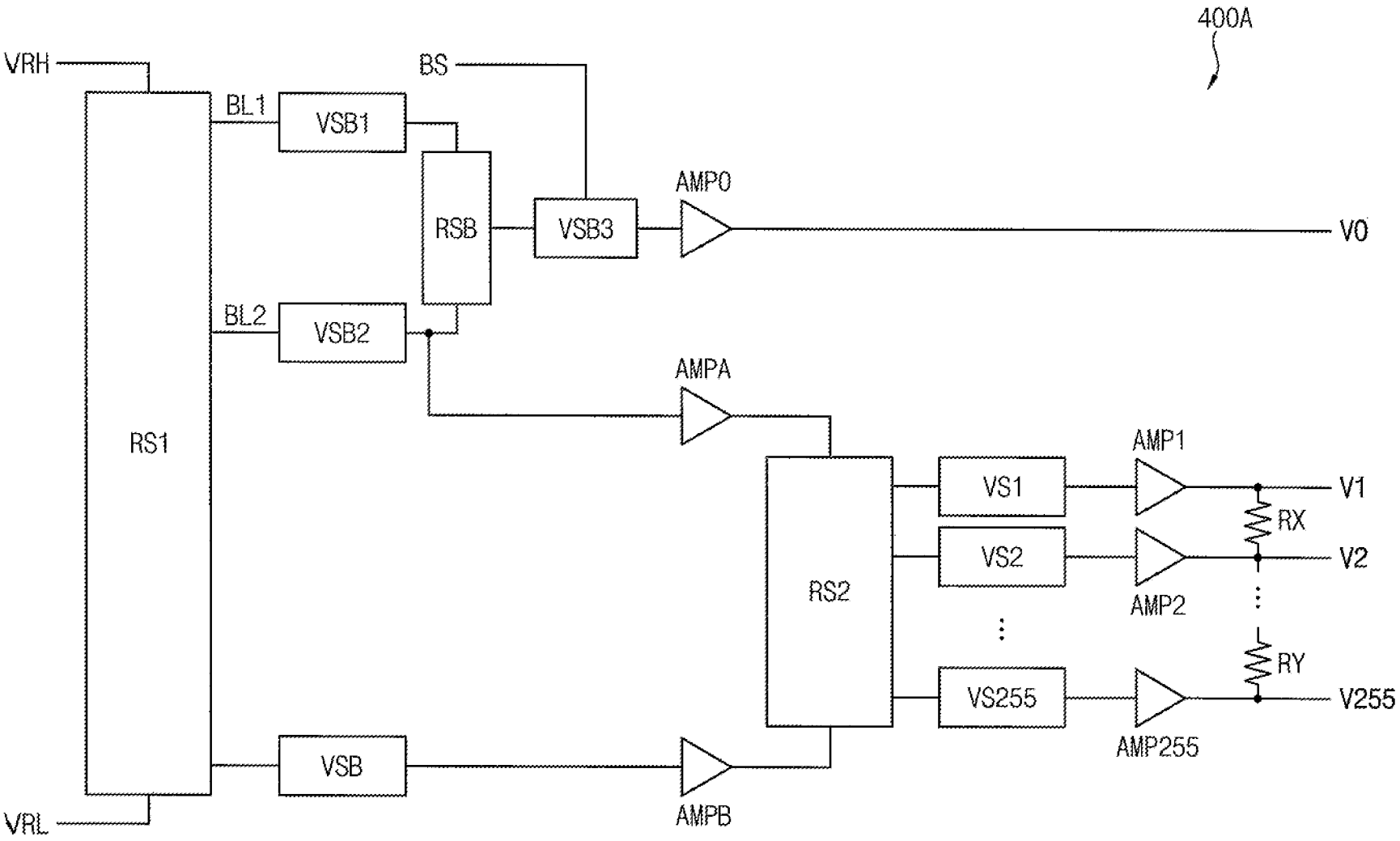
FIG. 8 illustrates an embodiment of a gamma reference voltage generator.

FIG. 7 is a block diagram illustrating an embodiment of displaying an image on a display panel 100, and FIG. 8 is a circuit diagram illustrating an embodiment of a gamma reference voltage generator 400A of FIG. 7. The gamma reference voltage generator and the display apparatus according to the present embodiment may be substantially the same as the gamma reference voltage generator and the display apparatus of the embodiment of FIGS. 1 to 5, except for the structure and the operation of the selector of the gamma reference voltage generator. Thus, the same reference numerals will be used to refer to the same or like parts as those described in the previous embodiment of FIGS. 1 to 5.

Referring to FIGS. 1, 4, 5, 7, and 8, the display apparatus includes a display panel 100 and a display panel driver. The display panel driver includes a driving controller 200, a gate driver 300, a gamma reference voltage generator 400A and a data driver 500. The display apparatus may further include a host 600 or the host 600 may be an external element coupled to the display apparatus.

The display panel 100 displays an image based on image data. The driving controller 200 receives the input image data IMG and converts the input image data IMG to the data signal DATA. The gamma reference voltage generator 400A generates a gamma voltage corresponding to the data signal DATA, the data driver 500 outputs the gamma voltage to the display panel 100 based on the data signal DATA.

A black gamma voltage output to the display panel 100 may be selected among a plurality of black candidate voltages based on a selection signal, e.g., a black level command signal BLC. The host 600 may output the input image data IMG and the black level command signal BLC to the driving controller 200. For example, the input image data IMG may include a grayscale value in a grayscale range of the display panel, e.g., a range between 0 and 255. The grayscale range may be a different range in another embodiment.

In the present embodiment, the number of black candidate reference voltages may be two and the black voltage may be determined at a level between the two black candidate reference voltages. Thus, in this example, the number of the black candidate voltages may be much larger than the embodiments of FIGS. 2 and 3. For illustrative purposes, FIG. 7 illustrates a case in which the number of black candidate voltages is 100. Accordingly, the black level command signal BLC may have one hundred values ranging from 0 to 99.

The driving controller 200 may include a lookup table LUT storing output data OUTPUT corresponding to an input grayscale value INPUT of the input image data IMG In the present embodiment, the lookup table LUT may not store an output value for a grayscale value of 0, but may store output values for all or a portion of grayscale values except for 0. The grayscale value of 0 of the input image data IMG may correspond to a black gray scale value.

The gamma reference voltage generator 400A may receive two black candidate reference voltage setting values BL1 and BL2. The gamma reference voltage generator 400A may include a first resistor string RS1, a plurality of black voltage setters VSB1 and VSB2, a selector RSB and VSB3, a second resistor string RS2 and a plurality of gamma voltage setters VS1, VS2, . . . , VS255.

In the present embodiment, the black voltage setters VSB1 and VSB2 may extract the two black candidate reference voltages from the first resistor string RS1. For example, a first black candidate voltage setting value BL1 may be applied to a first black voltage setter VSB1. A specific voltage between the high reference voltage VRH and the low reference voltage VRL may be extracted from the first resistor string RS1 as a first black candidate reference voltage according to the first black candidate voltage setting value BL1. A second black candidate voltage setting value BL2 may be applied to a second black voltage setter VSB2. A specific voltage between the high reference voltage VRH and the low reference voltage VRL may be extracted from the first resistor string RS1 as a second black candidate reference voltage according to the second black candidate voltage setting value BL2.

The selector may include a third resistor string RSB, to receive the first black candidate reference voltage and the second black candidate reference voltage, and a final black voltage setter VSB3 to extract the black gamma voltage from the third resistor string RSB. The final black voltage setter VSB3 may extract a final black gamma voltage.

The gamma reference voltage generator 400A may further include a black gamma voltage output amplifier AMP0 connected to the final black voltage setter VSB3.

A first voltage and a second voltage may be applied to the second resistor string RS2. The first voltage may be one of the black candidate reference voltages (e.g. voltages corresponding to the first and second black voltage setters VSB1 and VSB2). For example, the first voltage may be a minimum voltage (a voltage corresponding to the second black voltage setter VSB2) among the black candidate reference voltages. The second voltage may be extracted from the first resistor string RS1. The second voltage may be extracted from the first resistor string RS1 by a second voltage setter VSB.

The gamma reference voltage generator 400A may further include a first amplifier AMPA and a second amplifier AMPB. The first amplifier AMPA may output the first voltage to the second resistor string RS2. The second amplifier AMPB may output the second voltage to the second resistor string RS2. In FIG. 8, the first amplifier AMPA is connected to the second black voltage setter VSB2, but the first amplifier AMPA may be connected to the first black voltage setter VSB1 in another embodiment.

According to the present embodiment, the black grayscale value of the display apparatus may be properly selected using the selector of the gamma reference voltage generator 400A. In one embodiment, the black grayscale value of the display apparatus may be properly selected to reduce or prevent an FFR issue, e.g., in which luminance corresponding to the white grayscale value does not reach the desired luminance in the first frame that changes from the black grayscale value to the white grayscale value. Additionally, or alternatively, a leakage current issue (e.g., in which the display panel does not represent a single color low grayscale image due to current leakage between the channels of the color pixels (e.g., red pixels, green pixels, blue pixels) may be reduced or prevented. Therefore, display quality of the display panel may be enhanced.

Figure 9:
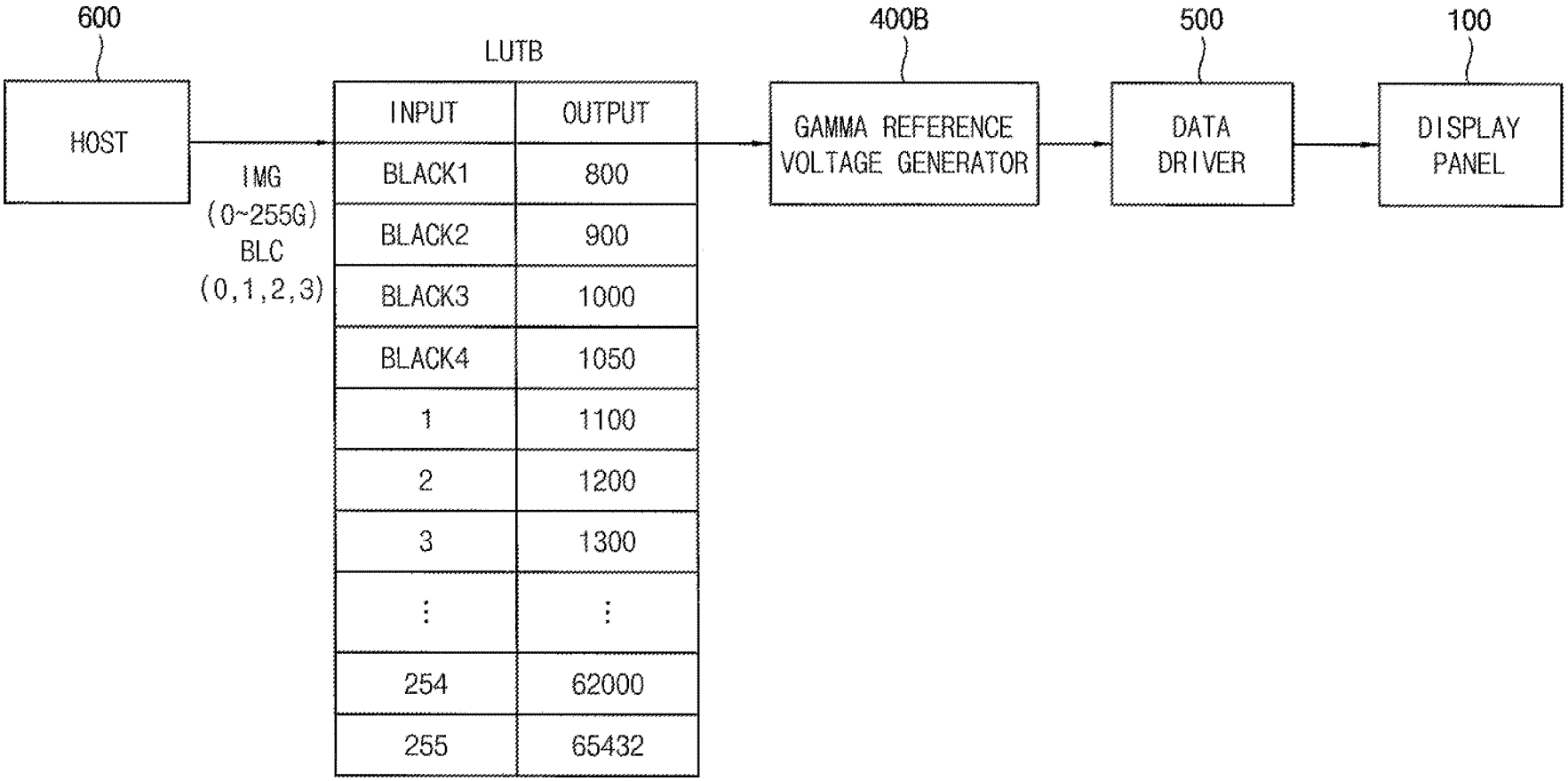
FIG. 9 illustrates an embodiment of displaying an image on a display panel.
Figure 10:
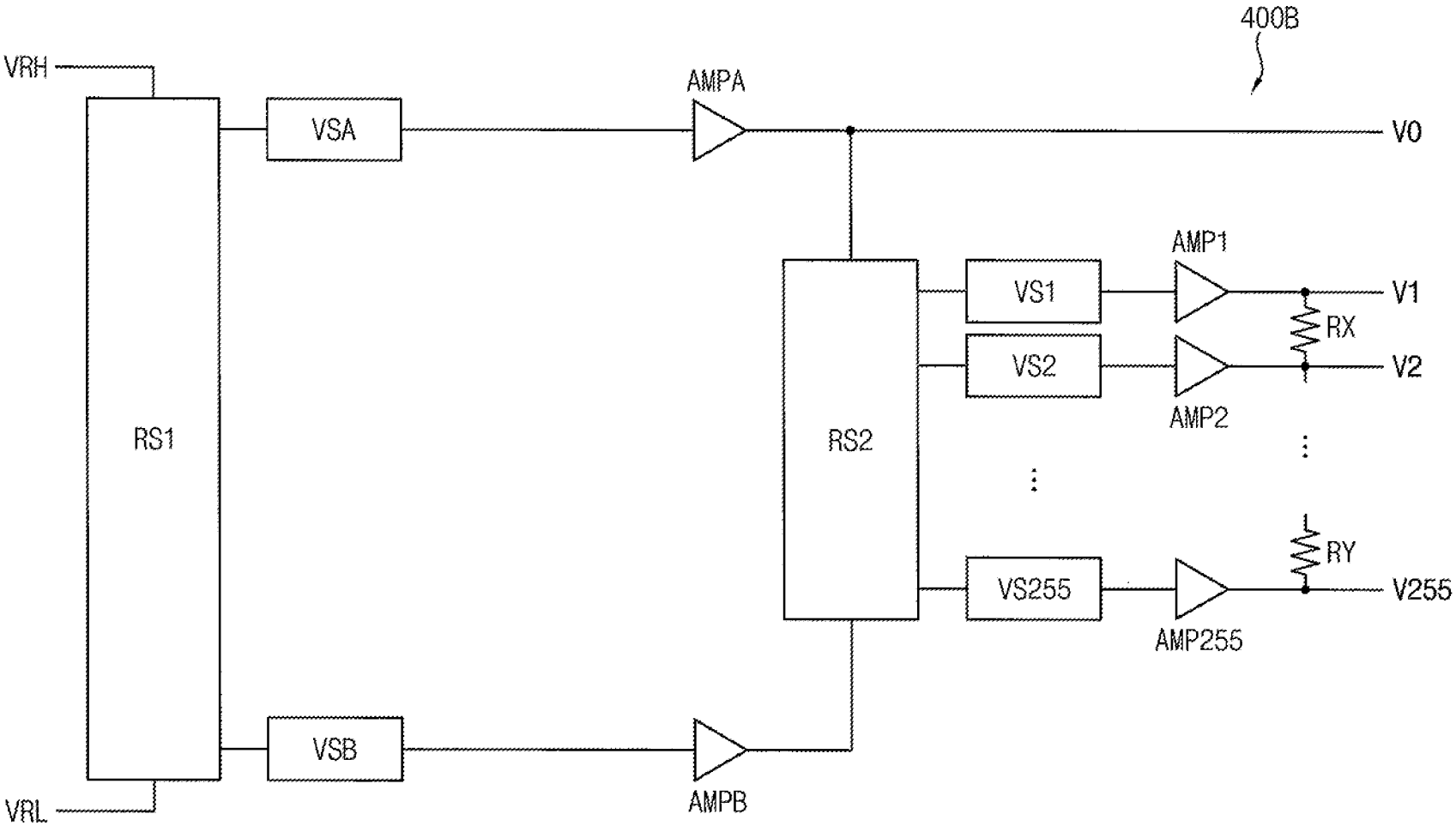
FIG. 10 illustrates an embodiment of a gamma reference voltage generator.

FIG. 9 is a block diagram illustrating an embodiment of displaying an image on a display panel 100, and FIG. 10 is a circuit diagram illustrating an embodiment of a gamma reference voltage generator 400B of FIG. 9. The gamma reference voltage generator and the display apparatus according to the present embodiment may be substantially the same as the gamma reference voltage generator and the display apparatus of the embodiment of FIGS. 1 to 5, except for the structure and the operation of the selector of the gamma reference voltage generator. Thus, the same reference numerals will be used to refer to the same or like parts as those described in the embodiment of FIGS. 1 to 5.

Referring to FIGS. 1, 4, 5, 9 and 10, the display apparatus includes a display panel 100 and a display panel driver. The display panel driver includes a driving controller 200, a gate driver 300, a gamma reference voltage generator 400B and a data driver 500. The display apparatus may further include a host 600 or host 600 may be an external element coupled to the display apparatus. The display panel 100 displays an image.

The driving controller 200 receives the input image data IMG and converts the input image data IMG to the data signal DATA. The gamma reference voltage generator 400B generates a gamma voltage corresponding to the data signal DATA. The data driver 500 outputs the gamma voltage to the display panel 100 based on the data signal DATA.

A black gamma voltage outputted to the display panel 100 may be selected among a plurality of black candidate voltages based on a selection signal. e.g., a black level command signal BLC. The host 600 may output the input image data IMG and the black level command signal BLC to the driving controller 200. For example, the input image data IMG may include a grayscale value in a predetermined grayscale range of the display panel 100, e.g., a range between 0 and 255. The range may be different in another embodiment.

In one example, the number of the black candidate voltages is four. In this case the black level command signal BLC may have four values of 0, 1, 2 and 3. When the black level command signal BLC has a value of 0, a first black candidate voltage may be selected to be the black gamma voltage. When the black level command signal BLC has a value of 1, a second black candidate voltage may be selected to be the black gamma voltage. When the black level command signal BLC has a value of 2, a third black candidate voltage may be selected to be the black gamma voltage. When the black level command signal BLC has a value of 3, a fourth black candidate voltage may be selected to be the black gamma voltage. The number of black candidate voltages may be different from four in another embodiment.

The driving controller 200 may include a lookup table LUTB storing output data OUTPUT corresponding to an input grayscale value INPUT of the input image data IMG In the present embodiment, the lookup table LUTB may store a plurality of candidate data (e.g. 800, 900, 1000 and 1050) corresponding to a grayscale value of 0. The lookup table LUTB may output one of the candidate data (e.g. 800, 900, 1000 and 1050) as a black data signal based on the selection signal BS to the gamma reference voltage generator 400B.

In the present embodiment, the gamma reference voltage generator 400B may not include an additional selector, and may output the black gamma voltage corresponding to the black data signal (e.g. one of 800, 900, 1000, or 1050).

The gamma reference voltage generator 400B may further include a first resistor string RS1, a second resistor string RS2, a black gamma voltage generator VSA setting the black gamma voltage, a black voltage output amplifier AMPA outputting the black gamma voltage, a second voltage setter VSB extracting a second voltage from the first resistor string RS1 and a second voltage amplifier AMPB outputting the second voltage to the second resistor string RS.

The gamma reference voltage generator 400B may further include a plurality of gamma voltage setters VS1, VS2, . . . , VS255 extracting the gamma voltages V1, V2, . . . , V255 from the second resistor string RS2. The gamma reference voltage generator 400B may further include a plurality of gamma voltage output amplifiers AMP1, AMP2, . . . , AMP255 respectively connected to the gamma voltage setters VS1, VS2, . . . , VS255.

According to the present embodiment, the black grayscale value of the display apparatus may be properly selected using the lookup table LUTB of the driving controller 200. The black grayscale value of the display apparatus may be properly selected so that an FFR issue (e.g., in which the luminance corresponding to the white grayscale value does not reach a desired luminance in the first frame that changes from the black grayscale value to the white grayscale value) may be reduced or prevented. In addition, a leakage current issue (e.g., in which the display panel does not represent the single color low grayscale image due to the current leakage between the channels of color pixels (e.g., red pixels, green pixels, blue pixels)) may be reduced or prevented. Therefore, display quality of the display panel 100 may be enhanced.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods herein.

Also, another embodiment may include a computer-readable medium, e.g., a non-transitory computer-readable medium, for storing the code or instructions described above. The computer-readable medium may be a volatile or non-volatile memory or other storage device, which may be removably or fixedly coupled to the computer, processor, controller, or other signal processing device which is to execute the code or instructions for performing the method embodiments or operations of the apparatus embodiments herein.

The controllers, processors, selectors, setters, devices, modules, units, multiplexers, generators, logic, interfaces, decoders, drivers, generators and other signal generating and signal processing features of the embodiments disclosed herein may be implemented, for example, in non-transitory logic that may include hardware, software, or both. When implemented at least partially in hardware, the controllers, processors, devices, modules, units, selectors, setters, multiplexers, generators, logic, interfaces, decoders, drivers, generators and other signal generating and signal processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the controllers, processors, devices, modules, units, multiplexers, generators, logic, interfaces, setters, selectors, decoders, drivers, generators and other signal generating and signal processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

The foregoing is illustrative of the present inventive concept and is not to be construed as limiting thereof. Although a few embodiments of the present inventive concept have been described, those skilled in the art will readily appreciate that many modifications are possible in the embodiments without materially departing from the novel teachings and advantages of the present inventive concept. Accordingly, all such modifications are intended to be included within the scope of the present inventive concept as defined in the claims. In the claims, means-plus-function clauses are intended to cover the structures described herein as performing the recited function and not only structural equivalents but also equivalent structures. Therefore, it is to be understood that the foregoing is illustrative of the present inventive concept and is not to be construed as limited to the specific embodiments disclosed, and that modifications to the disclosed embodiments, as well as other embodiments, are intended to be included within the scope of the appended claims. The present inventive concept is defined by the following claims, with equivalents of the claims to be included therein. The embodiments may be combined to form additional embodiments.

What is claimed is:

1. A gamma reference voltage generator, comprising:

a first resistor string configured to receive a first reference voltage and a second reference voltage;

a plurality of black voltage setters configured to extract a plurality of black candidate voltages from the first resistor string;

a selector configured to select one of the black candidate voltages as a black gamma voltage based on a selection signal, the selection signal generated based on a black level command signal applied from a host;

a second resistor string configured to receive a first voltage and a second voltage, the second voltage extracted from the first resistor string, and the first voltage extracted from the first resistor string and transmitted from one of the black voltage setters to the second resistor string without being transmitted through the selector; and a plurality of gamma voltage setters configured to extract a plurality of gamma voltages from the second resistor string, wherein the first voltage is predetermined from the black candidate voltages independently from the black gamma voltage.

2. The gamma reference voltage generator of claim 1, wherein the selector comprises a decoder configured to output one of the black candidate voltages in response to the selection signal.

3. The gamma reference voltage generator of claim 2, further comprising:

a black gamma voltage output amplifier connected to the decoder.

4. The gamma reference voltage generator of claim 1, wherein the first voltage is a minimum voltage among the black candidate voltages.

5. The gamma reference voltage generator of claim 1, further comprising:

a first amplifier configured to output the first voltage to the second resistor string; and a second amplifier configured to output the second voltage to the second resistor string.

6. The gamma reference voltage generator of claim 1, further comprising:

a plurality of gamma voltage output amplifiers respectively connected to the plurality of the gamma voltage setters.

7. The gamma reference voltage generator of claim 6, further comprising:

a plurality of output resistors connected between the plurality of gamma voltage output amplifiers.

8. The gamma reference voltage generator of claim 1, wherein the selector comprises:

a third resistor string configured to receive a first black candidate voltage and a second black candidate voltage; and a final black voltage setter configured to extract the black gamma voltage from the third string.

9. The gamma reference voltage generator of claim 8, further comprising:

a black gamma output amplifier connected to the final black voltage setter.

10. A display apparatus, comprising:

a display panel configured to display an image;

a driving controller configured to receive input image data and to convert the input image data into a data signal;

a gamma reference voltage generator configured to generate a black gamma voltage and a plurality of gamma voltages corresponding to the data signal; and a data driver configured to output the black gamma voltage to the display panel based on the data signal with the plurality of gamma voltages, wherein the gamma reference voltage generator is configured to select one of a plurality of black candidate voltages as the black gamma voltage to be output to the display panel based on a selection signal, wherein the plurality of gamma voltages is generated based on a first voltage, wherein the selection signal is based on a black level command signal from a host, wherein the first voltage is predetermined from the black candidate voltages independently from the black gamma voltage, and wherein the gamma reference voltage generator comprises:

a first resistor string configured to receive a first reference voltage and a second reference voltage;

a plurality of black voltage setters configured to extract the black candidate voltages from the first resistor string;

a selector configured to select the one of the black candidate voltages as the black gamma voltage based on the selection signal; and a second resistor string configured to receive the first voltage which is the predetermined one of the black candidate voltages and a second voltage extracted from the first resistor string, wherein the first voltage is extracted from the first resistor string and transmitted from one of the black voltage setters to the second resistor string without being transmitted through the selector.

11. The display apparatus of claim 10, wherein the gamma reference voltage generator further comprises:

a plurality of gamma voltage setters configured to extract the plurality of gamma voltages from the second resistor string.

12. The display apparatus of claim 11, wherein the selector comprises a decoder configured to output one of the black candidate voltages in response to the selection signal.

13. The display apparatus of claim 11, wherein the selector comprises:

a third resistor string configured to receive a first black candidate voltage and a second black candidate voltage; and a final black voltage setter configured to extract the black gamma voltage from the third string.

14. The display apparatus of claim 11, wherein:

the driving controller includes a lookup table, the lookup table is configured to store output values for a predetermined number of grayscale values of the input image data, except for an output value for a grayscale value of 0.

15. The display apparatus of claim 10, wherein:

the driving controller includes a lookup table, and the lookup table is configured to store a plurality of candidate data corresponding to a grayscale value of 0 of the input image data, and is configured to output one of the candidate data as a black data signal based on the selection signal to the gamma reference voltage generator.

16. The display apparatus of claim 15, wherein the gamma reference voltage generator is configured to output the black gamma voltage corresponding to the black data signal.

17. The display apparatus of claim 10, further comprising:

a first nonvolatile memory configured to store a black selection enable signal input from the host and a set black value and a module black value set by the driving controller, wherein the selection signal is to select one of the set black value or the module black value in response to the black selection enable signal.

18. The display apparatus of claim 17, wherein the first nonvolatile memory includes a onetime programmable memory.

19. The display apparatus of claim 10, further comprising:

a first nonvolatile memory configured to store a black selection enable signal and a set black value input from the host; and a second nonvolatile memory configured to store a module black value set by the driving controller, wherein the selection signal is to select one of the set black value and the module black value in response to the black selection enable signal.

20. The display apparatus of claim 19, wherein:

the first nonvolatile memory is a flash memory, and the second nonvolatile memory includes a one time programmable memory.

21. The gamma reference voltage generator of claim 1, wherein the one of the black candidate voltages selected as the black gamma voltage sets a luminance of a white grayscale value to a desired luminance in a first frame, of received data, that changes from a black grayscale value to the white grayscale value.

22. The gamma reference voltage generator of claim 1, wherein the predetermined one of the black candidate voltages is determined independent from the selector.

* * * * *